US005412857A

United States Patent [19]

Azrielant et al.

[11] Patent Number: 5,412,857

[45] Date of Patent: May 9, 1995

[54] METHOD OF MAKING A HINGE FOR A NECKLACE

[75] Inventors: Ofer Azrielant, New York; Alex Gal, Holliswood; Kenneth Lautman, Long Beach, all of N.Y.

[73] Assignee: Andin International, Inc., New York, N.Y.

[21] Appl. No.: 940,236

[22] Filed: Sep. 3, 1992

Related U.S. Application Data

[62] Division of Ser. No. 414,362, Sep. 29, 1989, Pat. No. 5,148,689.

[51] Int. Cl.[6] ..... B21F 43/00

[52] U.S. Cl. ..... 29/160.6

[58] Field of Search ..... 29/160.6; 63/2, 4, 18, 63/19, 21–24

[56] References Cited

U.S. PATENT DOCUMENTS

| | | | |
|---|---|---|---|
| 229,257 | 6/1880 | King | 63/21 |
| D. 263,028 | 2/1982 | Gilford . | |
| D. 335,247 | 2/1986 | Schlag | 63/21 X |
| 784,891 | 3/1905 | Saart | 63/2 X |
| 1,598,333 | 12/1922 | Young . | |
| 2,418,812 | 12/1946 | Karasik | 63/4 X |
| 2,527,090 | 10/1950 | Bauman | 63/21 X |
| 2,748,577 | 6/1956 | O'Callaghan | 63/19 X |
| 3,269,145 | 8/1966 | Druskin | 63/4 |
| 3,421,341 | 1/1969 | Hodge | 63/4 |
| 3,850,010 | 11/1974 | Noto | 63/2 |
| 4,106,123 | 8/1978 | Freedman | 403/209 |
| 4,334,413 | 6/1982 | Gaston et al. . | |
| 4,381,653 | 5/1983 | Diehl | 63/2 |
| 4,809,416 | 3/1989 | Poltash | 29/160.6 |

FOREIGN PATENT DOCUMENTS

| | | | |
|---|---|---|---|
| 2246933 | 4/1974 | Germany | 63/2 |
| 2411573 | 9/1975 | Germany | 63/2 |
| 420699 | 3/1967 | Switzerland | 63/2 |
| 10404 | of 1903 | United Kingdom | 63/21 |

*Primary Examiner*—P. W. Echols

*Attorney, Agent, or Firm*—James A. Drobile; Robert E. Rosenthal

[57] ABSTRACT

A necklace having a chain and a jewelry element has attaching members at each end of the chain and two pins extending from a rear surface of the jewelry element, with the pins disposed through the attaching members and bent back to the rear surface. A jewelry element having two L-shaped members, with a pin extending from an upright side of each and having an opposite end in close proximity to a base of each L-shaped member is disclosed. A jewelry element may have two pins attached at one end, terminating at the other end in a ball and disposed through attaching members, attached to ends of a chain. A method of making a necklace from a jewelry element having two pins extending from a rear surface thereof and a chain having attaching members at each end includes placing each attaching member over a pin and bending each pin back to the rear surface or heating each pin to form a ball at the end thereof.

6 Claims, 2 Drawing Sheets

METHOD OF MAKING A HINGE FOR A NECKLACE

This is a divisional of application Ser. No. 07/414,362 filed on Sep. 29, 1989, now U.S. Pat. No. 5,148,689.

BACKGROUND OF THE INVENTION

This invention relates to necklaces. This invention more particularly relates to necklaces having a jewelry element hanging from a chain. This invention relates particularly to means for attaching the ends of a chain to a jewelry element in such a manner that the chain may freely move with respect to the jewelry element.

It is common for necklaces to include a jewelry element, with provision therein for the placement of one or more precious stones, which jewelry element is attached at two points to the ends of a chain. It is well known in the art of manufacturing necklaces to solder each end of the chain directly to the jewelry element, thereby creating a rigid joint. However, such a rigid joint does not afford any freedom of movement between the jewelry element and the chain. In ordinary wearing and handling of the necklace, the rigid joint between the jewelry element and the chain will be subject to various stresses. The soldered rigid joint is ill-suited to withstand such stresses, and will commonly be weakened and eventually break from ordinarily handling and wearing. Moreover, the chain may easily become bent or kinked, resulting in damage to the chain.

It is also known to manufacture a jewelry element with two parallel projecting members extending therefrom connected by a pin. A loop attached to the end of a chain is placed around the pin. This design allows the ends of the chain to rotate about the pin, thus affording freedom of movement in one plane with respect to the jewelry element. However, depending upon the orientation of the parallel projecting members, in this design, the connection between the jewelry element and the flexible chain is visible when the necklace is being worn, which is generally regarded as undesirable in more expensive jewelry. Furthermore, because there is freedom of movement in only one plane between the chain and the jewelry element, stresses are created on the end of the chain and the pin, eventually leading to breakage. In addition, because there is freedom of movement in only one plane, this design is subject to the danger of the chain becoming bent or kinked, resulting in damage to the chain.

OBJECTS OF THE INVENTION

It is an object of the invention to provide a jewelry element that has provision therein for attaching a chain thereto, whereby the chain may move with respect to the jewelry element in two planes.

It is a further object of the invention to provide a jewelry element for a necklace that allows a chain to be attached thereto having freedom of movement with respect to the jewelry element in two planes and having connections between the jewelry element and the chain that are not visible while the necklace is being worn in an ordinary manner.

It is a further object of the invention to provide a necklace having a Jewelry element that allows a chain to be attached thereto having freedom of movement between the chain and the jewelry element, having connections between the jewelry element and the chain that are not visible while the necklace is being worn in an ordinary manner, and further having a member for attachment to each end of the chain that will provide a strong connection between the chain and the jewelry element of the necklace and allow the chain to move with respect to the jewelry element.

It is a further object of the invention to provide a method of manufacturing a necklace having a jewelry element attached to the ends of a chain, where there is freedom of movement between the jewelry element and the chain, and where the attachments between the jewelry element and the chain is not visible while the necklace is being worn in an ordinary manner.

Further objects and advantages of the invention will be apparent from the description of the invention which follows.

SUMMARY OF THE INVENTION

A necklace has a chain and a jewelry element having a substantially flat rear surface. Two pins are attached at different points to the rear surface. Each pin has one end extending substantially at right angles from the rear surface. The other end of each pin is bent in close proximity to the rear surface. Attaching members, each of which defines an aperture, are attached to each end of the chain. Each pin engages respectively an aperture in an attaching member, whereby the chain may move freely in relation to the jewelry element about the pins.

A necklace has a chain and a jewelry element having a substantially flat rear surface. Two pins are attached, at one end, at different points to the rear surface and each pin terminates at another end in a ball. An attaching member, which defines an aperture, is attached to each end of the chain. Each pin engages an aperture of an attaching member whereby each attaching member may move freely along and rotate about the corresponding pin.

A method of making a necklace from a chain having attaching members, each defining an aperture, attached at each end thereto, and a jewelry element having a substantially flat rear surface, and two pins attached to the rear surface at two different points and extending at right angles from the rear surface, includes the steps of inserting each pin through an aperture in an attaching member, and bending each pin so that an end of the pin is in close proximity to the rear surface of the jewelry element.

A method of making a necklace from a chain having attaching members, each defining an aperture, attached at each end thereto, and a jewelry element having a substantially flat rear surface and two pins attached to and extending from the rear surface at right angles, includes the steps of inserting each pin through an aperture in an attaching member, heating an end of each pin so as to create a ball, and allowing the ball to cool.

DETAILED DESCRIPTION OF THE INVENTION

Figure 1:
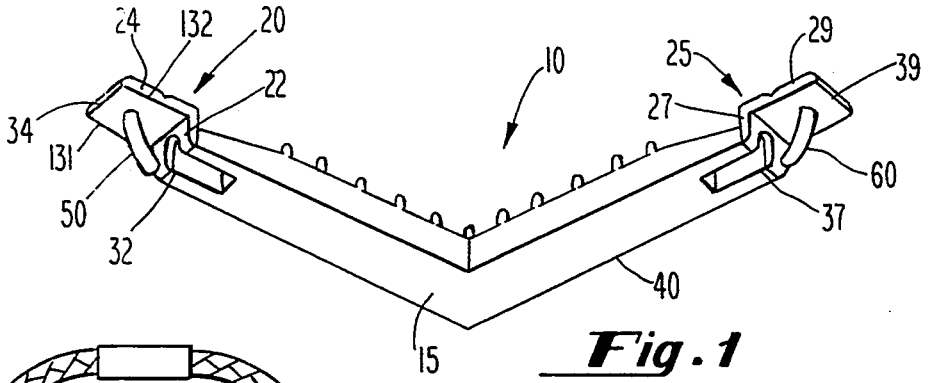
FIG. 1 is a perspective view of the rear of an embodiment of a jewelry element according to the invention.

With reference to FIG. 1, a rear view of a jewelry element 10 in accordance with the invention is shown. Such a jewelry element in accordance with the invention may have a design thereon. The jewelry element 10 has a configuration that is an example of a jewelry element of the invention. A jewelry element in accordance with the invention may have a large number of shapes, as will be perceived by those of skill in the art of jewelry design. The jewelry element may be manufactured by standard casting processes such as are well-known in the art of manufacturing jewelry. The jewelry element may be made from an alloy of gold, silver, or platinum. In FIG. 1, there is generally visible a rear surface 15 of the jewelry element. The rear surface is substantially flat. In the design depicted in FIG. 1, the largest portion of rear surface 15 is in a vertical plane. The rear surface 15 of jewelry element 10 has a perimeter 40, which is defined as a line around the jewelry element, which is along the edge, or horizon, of the jewelry element as visible when being worn in an ordinary manner. Thus no part of the rear surface 15 is visible when jewelry element 10 is being worn in an ordinary manner.

In the embodiment of jewelry element 10 depicted in FIG. 1, jewelry element 10 has a first L-shaped member 20 and a second L-shaped member 25 opposite first L-shaped member 20. First L-shaped member 20 has a base 22 and an upright side 24. Each L-shaped member is attached by its base to the remainder of the jewelry element. The angle between base 22 and upright side 24 may be ninety degrees, but the term "L-shaped member" is defined to include members where the angle between the base and the upright side is more or less than ninety degrees. Second L-shaped member 25 has a base 27 and an upright side 29. The angle between the base and the upright side in second L-shaped member 25 may be greater or less than ninety degrees. In the embodiment shown in FIG. 1, the angle between the base and the upright side is ninety degrees. The rear surface of the first upright side may be substantially parallel to the plane of the rear surface of the jewelry element. The rear surface of the second upright side may be substantially parallel to the plane of the rear surface of the jewelry element. The first upright side may be substantially rectangular, as shown in FIG. 1, or have a different shape. Similarly, the second upright side may be substantially rectangular or have a different shape.

A first pin 50 is attached at one end to the rear surface 15 of the jewelry element. In the embodiment shown in FIG. 1, first pin 50 is attached to a rear surface of upright side 24. In alternative embodiments not employing L-shaped members, first pin 50 may be attached elsewhere on the rear surface 15. First pin 50 may be substantially perpendicular to the rear surface of the upright side of first L-shaped member 20 at the point of attachment and extend rearwardly in a curving manner so that the other end of first pin 50 approaches base 22. In the embodiment depicted in FIG. 1, first pin 50 extends behind a rear edge of base 22. Between the two ends of the first pin, first pin 50 has a central section, which is a greater distance than either end from the rear surface of the jewelry element. A second pin 60 is attached at one end to the rear surface 15 of the jewelry element opposite to the first pin 50. In the embodiment depicted in FIG. 1, second pin 60 is attached to a rear surface of the upright side of second L-shaped member 25. Second pin 60 may be substantially perpendicular to the rear surface at the point of attachment and extend rearwardly in a curving manner so that the other end of second pin 60 approaches base 27. In the embodiment as depicted in FIG. 1, second pin 60 extends behind a rear edge of base 27. Between the ends of the second pin, second pin 60 has a central section, which is a greater distance than either end from the rear surface of the jewelry element.

First pin 50 and second pin 60 may, but do not necessarily, both extend from the rear surface of the jewelry element close to an upper portion of perimeter 40. For example, in the embodiment shown in FIG. 1, first pin 50 is close to edge 34 of upright side 24, which includes an upper portion of perimeter 40, and second pin 60 is close to edge 39 of upright side 29, which also includes an upper portion of perimeter 40. Accordingly, in the design depicted in FIG. 1, the large portion of rear surface 15 lies in a vertical plane, when the necklace is being worn in an ordinary manner.

In the embodiment depicted in FIG. 1, a notch 32 is formed in base 22 and the rear surface of the jewelry element. The width of notch 32 is slightly larger than a diameter of the first pin 50. Similarly, a notch 37 is formed in base 27 and the rear surface of the jewelry element. Notch 37 has a width slightly larger than the diameter of second pin 60. However, the L-shaped members may be included in the invention without notches.

Figure 2:
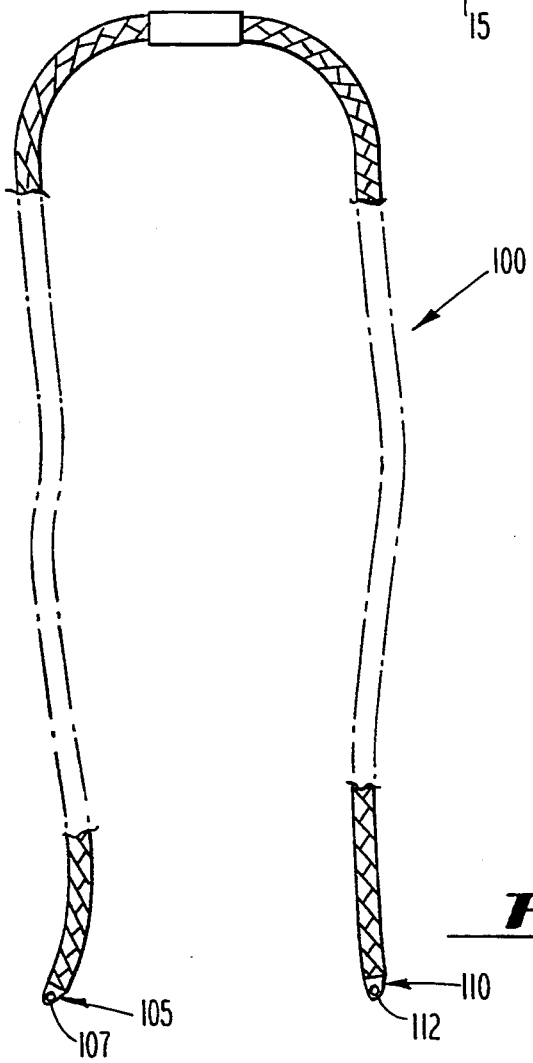
FIG. 2 is a plan view of a chain according to the invention.

With reference to FIG. 2, a chain 100 is shown. This chain may be any one of a large number of designs well-known in the art of manufacturing jewelry. The chain 100 has at one end a first attaching member 105 and at a second end a second attaching member 110. These attaching members may have any form so long as each has at least one aperture formed therein. First attaching member 105 has a first aperture 107. Second attaching member 110 has a second aperture 112. An inner diameter of first aperture 107 must be greater than a diameter of first pin 50, and an inner diameter of second aperture 112 must be greater than a diameter of second pin 60, so that each pin can fit through the aperture of the corresponding attaching member.

Figure 4:
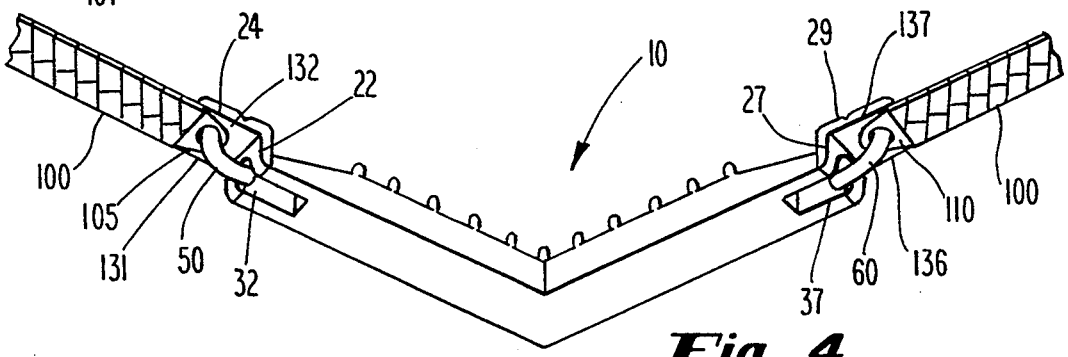
FIG. 4 is a cutaway side elevational view of an embodiment of a necklace of the invention.

In the manufacture of a complete necklace, including a jewelry element and a chain having attaching members at each end, each attaching member is fitted over the corresponding pin. Then the pin is bent toward the rear surface of the jewelry element. In the embodiment depicted in FIG. 1, the pin is bent to the base of the corresponding L-shaped member, until the pin is in close proximity to the base. The term "close proximity" encompasses a pin in contact with the rear surface and a pin not in contact with the rear surface but so close that the attaching member cannot pass between the end of the pin and the rear surface. This bending step may be accomplished with a pair of needle nose pliers. The result of this process is depicted in FIG. 4. With reference to FIG. 4, first pin 50 has been bent back to rest within notch 32, and second pin 60 has been bent back to rest within notch 37. First pin 50 is disposed through first attaching member 105. Second pin 60 is disposed through second attaching member 110. Each pin forms an arc of approximately ninety degrees. Thus, the attaching member may travel along the pin and, because of the curvature of the pin, rotate approximately 90 degrees with respect to the jewelry element. If the angle between the upright side and the base of the L-shaped plate member is greater than 90 degrees, then the pin may curve through an angle of more than 90 degrees; accordingly, the attaching member could rotate more than 90 degrees. Each attaching member may also rotate about the pin at any point along the pin, thus providing a second plane in which to move. Thus the chain and the pin will not be subject to as much stress in ordinary wearing of the necklace as in prior art designs, so that the necklace will last longer.

In an alternative embodiment (not illustrated), the jewelry element does not have L-shaped members. Rather, the pins are attached to the rear surface of the jewelry element. The pins are disposed through attaching members, which are attached to each end of a chain. The pins are then bent so that the other end is in close proximity with the rear surface, and each pin forms approximately a U-shape.

Figure 5:
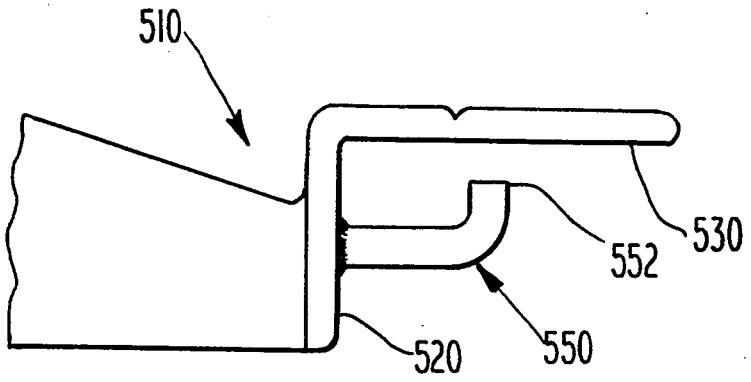
FIG. 5 is a side elevational view of an alternative embodiment of a hinge of a jewelry element of the invention.
Figure 6:
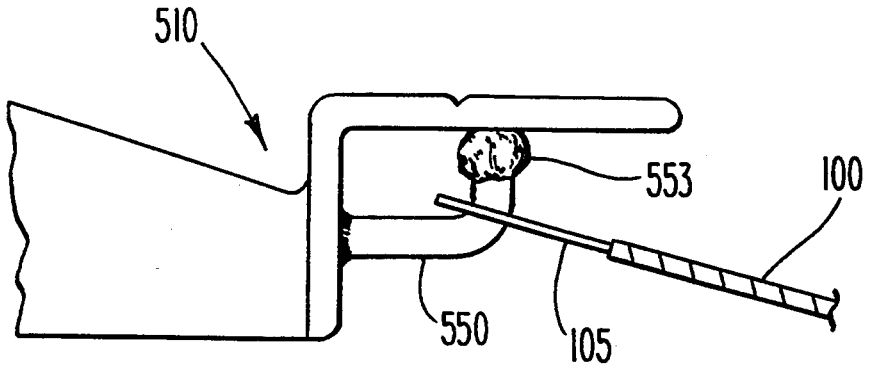
FIG. 6 is a side elevational view of an alternative embodiment of a hinge and an attaching member of the invention.

A hinge portion of an alternative embodiment of the jewelry element is depicted in FIG. 5. One of the L-shaped members of jewelry element 510 is shown. One end of a first pin 550 is attached to a base 520 of the L-shaped member. The other end of first pin 550 is not attached, and is referred to as the free end 552. First pin 550 may be curved toward a rear surface of upright side 530 of the L-shaped member. By way of example, first pin 550 may form an arc of approximately ninety degrees. A first attaching member, which is attached to one end of a chain and has a first aperture, is slipped over the first pin so that the first pin is disposed through the first aperture. Then, the free end 552 of first pin 550 is heated to the melting point of the material of which the jewelry element is made. When the melting point is reached, as is well known in the art, the free end of the pin will rapidly form into a ball. As soon as the ball reaches a desired diameter, the heat is removed. Care must be taken that the heat is removed promptly; otherwise, the pin will melt closer to the other end of the pin and the ball will increase in size, with a corresponding loss in length of pin along which the attaching member may travel. The pin is then allowed to cool. The desired size of the ball is large enough that the aperture of the attaching member cannot move past the ball. A second pin, which is not shown, is similarly attached at one end to a base of an L-shaped member, and has one free end. A second attaching member is attached to the other end of the chain. The second attaching member has an aperture, which is slipped over the second pin. Then the free end of the second pin is heated to the melting point of the material of which the jewelry element is made. When the melting point is reached, as is well known in the art, the free end of the second pin will rapidly form into a ball. The heat is removed when the size of the ball is large enough to prevent the second aperture from moving past the ball. Care must be taken, as noted above, to remove the heat promptly. Thus in this embodiment, both pins extend from a rear surface of the jewelry element and terminate in a ball. The chain is securely attached on the jewelry element. FIG. 6 depicts an L-shaped member of jewelry element 510 after this process is completed. First attaching member 105, which is attached to chain 100, is able to move along first pin 550 to first ball 553 and to rotate about first pin 550. If, as shown, first pin 550 is curved, the attaching member may move in two planes with respect to the jewelry element.

Figure 7:
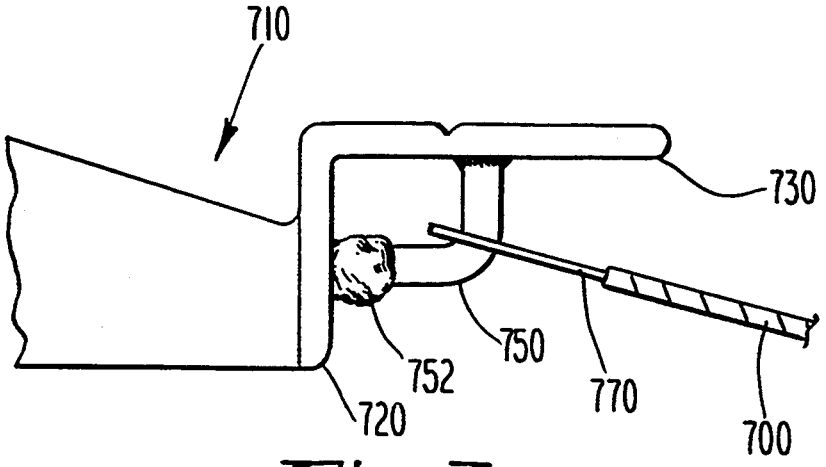
FIG. 7 is a side elevational view of another alternative embodiment of a hinge and an attaching member in a necklace of the invention.

Alternatively, as depicted in FIG. 7, first pin 750 may extend from a rear surface of an upright side and terminate in a ball. Jewelry element 710, an L-shaped member of which is shown, has a base 720 and an upright side 730. First pin 750 is attached at one end to a rear surface of upright side 730, and extends rearwardly therefrom. The pin may be curved toward base 720. The other end of first pin 750 is free. First ball 752 is at the free end of first pin 750. First pin 750 is disposed through first attaching member 770, which is attached to the end of chain 700 (not shown in its entirety). A first aperture (not shown), in first attaching member 770, has a diameter less than a diameter of first ball 752, but greater than a diameter of first pin 750.

A similar arrangement, which is not illustrated, is provided with regard to a second pin and a second attaching member. A second pin is attached at one end to a rear surface of an upright side, and extends rearwardly therefrom, curving toward a second base. The other end of the second pin is free. A second ball is at the free end of the second pin. The second pin is disposed through a second attaching member, which is attached to the other end of the chain. An aperture in the second attaching member is large enough to allow freedom of movement along the second pin, but not large enough to allow the attaching member to move past the second ball.

In an embodiment of the invention (not illustrated) where there is no L-shaped member, each pin extends rearwardly from different points on the rear surface of the jewelry element. Each pin curves and terminates in a ball. Each pin is disposed through an attaching member, which defines an aperture. Each attaching member is attached to the end of a chain. Because each pin curves, the corresponding attaching member can both rotate about the pin and move along the pin, rotating with respect to the jewelry element.

With reference to FIG. 4, the dimensions of first attaching member 105 and the location of first pin 50 with respect to the perimeter of the rear surface of the jewelry element may be, though need not be in accordance with the invention, selected so that the first attaching member is not visible when the necklace is being worn in an ordinary manner. Similarly, the dimensions of second attaching member 110 and the location of second pin 60 with respect to the perimeter 40 of the rear surface of the jewelry element may be, but need not be in accordance with the invention, selected so that the second attaching member is not visible when the necklace is being worn in an ordinary manner. In general, in accordance with this optional limitation, the length from a perimeter of an aperture in an attaching member to any point on the attaching member will be less than the length from any point on the corresponding pin to the perimeter of the rear surface of the Jewelry element. The length from any point on a pin to the perimeter of the rear surface of the jewelry element is measured, for the purposes of selecting dimensions so that attaching member is not visible, from the point on the pin to a point directly to the rear of the perimeter of the rear surface of the jewelry element and in a vertical plane that includes the point on the pin. In the embodiment depicted in FIG. 4, the distance from the point where first pin 50 attaches on a rear surface of the upright side 24 to the closest point on the perimeter of the rear surface of the jewelry element, which will be an edge of the upright side 24, must be greater than the length from a perimeter of first aperture 107 in first attaching member 105, to the most distant point on first attaching member 105. Thus first pin 50 is attached near the center of the rear surface of upright side 24. The length from the point where second pin 60 attaches on a rear surface of upright side 29 to the closest point on the perimeter 40 of the rear surface of the jewelry element, which in the embodiment shown in, FIG. 4 will be an edge 39 of upright side 29, must be greater than the distance from a perimeter of second aperture 112 in second attaching member 110 to the most distant point on second attaching member 110. Thus, in the embodiment shown in FIG. 4, it is desirable for first pin 50 to attach on first L-shaped member 20 on the rear surface of upright side 24 at a point which is centrally located between edge 131 and edge 132 of upright side 24, and which is as close as possible to base 22, consistent with first attaching member 105 being able to rotate freely about the first pin, except to the extent that the rotation is blocked by chain 100. Similarly, it is desirable for second pin 60 to attach on the rear surface of upright side 29 at a point which is centrally located between edge 136 and edge 137 of upright side 29, and which is as close as possible to base 27, consistent with second attaching member 110 being able to rotate freely about the second pin, except to the extent that the rotation is blocked by chain 100. Thus, the chain is free to rotate in two planes at both ends with respect to the jewelry element, and the connections between the chain and the jewelry element are not visible while the necklace is being worn, which is aesthetically important.

Figure 3:
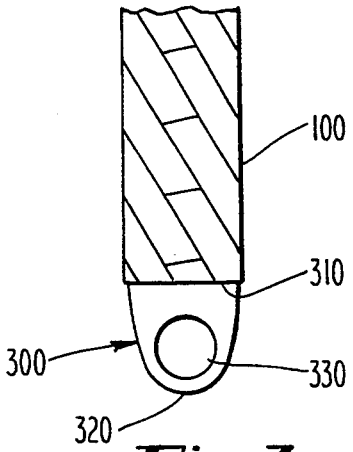
FIG. 3 is a plan view of an embodiment of an attaching member according to the invention.

With reference to FIG. 3, an embodiment of an attaching member is depicted. Of course, many other embodiments, which will be apparent to those skilled in the art of jewelry design, may be used in accordance with the invention. Attaching member 300 is in the shape of one-half of an ellipse, which ellipse has been cut in half along its short axis. Thus, the attaching member has a flat edge 310 and a curved end 320 opposite to the flat edge. Aperture 330 is centrally located in the attaching member and is substantially circular. The chain 100 is attached by soldering, by techniques well-known in the art, to the flat edge 310. Flat edge 310 may be, but is not necessarily, the same length as the width of the chain. By way of example, in one embodiment, the length of flat edge 310 is approximately 2.1 millimeters. In the same embodiment, the distance from flat edge 310 to aperture perimeter 335 is approximately 1.7 millimeters, and the diameter of the aperture 330 is approximately 1.0 millimeters. The distance from aperture perimeter 335 to the curved end 320 is approximately 0.6 millimeters. The thickness of the attaching member in this embodiment is small with respect to the other dimensions of the toroidal member. Thus, in this embodiment, the attaching member is substantially flat. By way of example, the thickness is from approximately 0.40 millimeters to approximately 0.45 millimeters. In an embodiment of the invention in which both the first attaching member and the second attaching member have the dimensions listed above, each of the pins may have a diameter of approximately 0.8 millimeters.

The attaching member is desirably manufactured in a standard die-stamping process that is well-known in the art. The desirable materials for the attaching member include alloys of gold, silver and platinum, that are also well-known in the art.

An embodiment of the invention in which the first attaching member and the second attaching member have the form shown in FIG. 3 is desirable because of the favorable properties resulting from the cooperation between the jewelry element and each attaching member. The favorable properties resulting from the cooperation include freedom of rotation of the attaching members along each pin, combined with the strength and small size of the attaching members. Each attaching member can move along the length of the corresponding pin. In addition, the attaching member may rotate with respect to the pin at any point along the length of the pin. This embodiment of the attaching member has been found to be quite durable. If the dimensions given as examples above are used, the resulting small size of the attaching member simplifies the process of design of the jewelry element to include an aesthetically pleasing design while ensuring that the attaching members are not visible while the necklace is being worn in an ordinary manner. While not rising to the level of a limitation, this feature is important in assuring that the hinge structure is not visible.

It will be appreciated that there are considerable variations that can be accomplished in a method and article of the invention without departing from its scope. As a result, although a preferred embodiment of a method and article of the invention has been described above, it is emphasized that the invention is not limited to a preferred embodiment, and there exist alternative embodiments that are fully encompassed within the invention's scope, which is intended only to be limited by the scope of the appended claims.

What is claimed is:

1. A method of making a necklace from a chain having an attaching member defining an aperture attached thereto at each end, and a jewelry element having a substantially flat rear surface, and two pins, each attached at one end to two different points on said rear surface, comprising the steps of:

(a) inserting each of said pins through one of said apertures of said attaching members; and (b) bending each of said pins so that an opposite end of each of said pins is in close proximity to said rear surface of said jewelry element;

wherein said jewelry element includes two L-shaped members, each comprising a base and an upright side, each of said upright sides having an interior surface, the bases of which are joined to opposite points of said jewelry element so that the interior surfaces of the upright sides of said L-shaped members are oriented substantially parallel to the plane of said rear surface, each of said pins being attached to one of said upright sides, and in said step of bending said pins are bent so that each pin is in close proximity to the base of the corresponding L-shaped member.

2. A method as recited in claim 1, wherein said bases of said L-shaped members and said rear surface of said jewelry element include notches, and in said step of bending said pins are bent to be received within said notches.

3. A method of making a necklace from a chain having an attaching member defining an aperture attached thereto at each end, and a jewelry element having a substantially flat rear surface, and two pins, each attached at one end to two different points on said rear surface, comprising the steps of:

(a) inserting each of said pins through one of said apertures of said attaching members; and (b) bending each of said pins so that an opposite end of each of said pins is in close proximity to said rear surface of said jewelry element;

wherein said jewelry element includes two L-shaped members, each comprising a base and an upright side, each of said upright sides having an interior surface, the bases of which are joined to opposite points of said jewelry element so that the interior surfaces of the upright sides of said L-shaped members are oriented substantially parallel to the plane of said rear surface, each of said pins being attached to one of said bases, and in said step of bending said pins are bent so that each pin is in close proximity to the upright side of the corresponding L-shaped member.

4. A method of making a necklace from a chain having an attaching member defining an aperture attached thereto at each end, and a jewelry element having a rear surface and two pins each attached at one end to and extending from said rear surface to terminate in a free end, comprising the steps of:

(a) inserting each of said pins through an aperture of one of said attaching members;

(b) heating said free end of each of said pins so as to create a ball at each of said free ends; and (c) allowing each of said balls to cool.

5. A method of making a necklace from a chain having an attaching member defining an aperture attached thereto at each end, and a jewelry element having a substantially flat rear surface and two L-shaped members, each of said L-shaped members having a base and an upright side, and each of said upright sides having an interior surface, the bases of which are joined to opposite points thereof so that the interior surfaces of the upright sides of said L-shaped members are oriented substantially parallel to the plane of said rear surface and two pins each attached at one end to an upright side and terminating in a free end, comprising the steps of:

(a) inserting each of said pins through an aperture of one of said attaching members;

(b) heating said free end of each of said pins so as to create a ball at each of said free ends; and (c) allowing each of said balls to cool.

6. A method of making a necklace from a chain having an attaching member defining an aperture attached thereto at each end, and a jewelry element having a substantially flat rear surface and two L-shaped members each of said L-shaped members having a base and an upright side, each of said upright sides having an interior surface, the bases of which are joined to opposite points thereof so that the interior surfaces of the upright sides of said L-shaped members are oriented substantially parallel to the plane of said rear surface and two pins each attached at one end to a base and terminating in a free end, comprising the steps of:

(a) inserting each of said pins through an aperture of one of said attaching members;

(b) heating said free end of each of said pins so as to create a ball at each of said free ends; and (c) allowing each of said balls to cool.

* * * * *